US006094010A

United States Patent [19]

Washio

[11] Patent Number: 6,094,010

[45] Date of Patent: Jul. 25, 2000

[54] ELECTRON GUN WITH PHOTOCATHODE AND FOLDED COOLANT PATH

[75] Inventor: Masakazu Washio, Yokohama, Japan

[73] Assignee: Sumitomo Heavy Industries, Ltd., Tokyo, Japan

[21] Appl. No.: 09/120,897

[22] Filed: Jul. 22, 1998

[30] Foreign Application Priority Data

Jul. 29, 1997 [JP] Japan ..... 9-203190

[51] Int. Cl.[7] ..... H01J 25/02

[52] U.S. Cl. ..... 315/5; 313/36

[58] Field of Search ..... 315/4, 5; 313/35, 313/36

[56] References Cited

U.S. PATENT DOCUMENTS

| | | | |
|---|---|---|---|
| 3,388,282 | 6/1968 | Hankin et al. | 315/4 |
| 4,313,072 | 1/1982 | Wilson et al. | 315/4 X |
| 4,703,228 | 10/1987 | West | 315/4 X |
| 4,749,906 | 6/1988 | Tran et al. | 315/5 |
| 5,043,630 | 8/1991 | Faillon et al. | 315/5 |
| 5,363,016 | 11/1994 | James | 313/36 X |

FOREIGN PATENT DOCUMENTS 0 251 830 A1 1/1988 European Pat. Off. .

OTHER PUBLICATIONS

Lehrman, I.S.: "Design of a High–Brightness, High–Duty Factor Photocathode Electron Gun", Jul. 1, 1992, Nuclear Instruments & Methods in Physics Research, Section—A: Accelerators, Spectrometers, Detectors and Associated Equipment, vol. A318, NR. 1/03, pp. 247–253 XP000296558.

Ilan Ben–ZVI: "The BNL Accelerator Test Facility and Experimental Program", May 6, 1991, Proceedings of the Particle Accelerator Conference, San Francisco, May 6–9, 1991, vol. 1, NR. Conf. 14, pp. 550–554, Institute of Electrical and Electronics Engineers, XP000267197.

B. Dwersteg et al: "RF Gun Design for the Tesla VUV Free Electron Laser", Nuclear Instruments and Methods in Physics Research A, vol. 393, Jul. 1, 1997, pp. 93–95, XP002079595.

*Primary Examiner*—Justin P. Bettendorf

*Attorney, Agent, or Firm*—Frishauf, Holtz, Goodman, Langer & Chick, P.C.

[57] ABSTRACT

In an electron gun, a conductive chamber defines a cavity. A photocathode is disposed in the cavity. Photoelectrons are emitted from the photocathode into the cavity when light is applied to the photocathode. A wave guide mounted on the conductive chamber introduces a micro wave into the cavity. Via an opening formed in the wall of the conductive chamber, the photoelectrons are output to the outside of the cavity. Coolant is flowed through a flow path formed in the wall of the conductive chamber, to suppress a temperature rise of the conductive chamber.

3 Claims, 6 Drawing Sheets

ELECTRON GUN WITH PHOTOCATHODE AND FOLDED COOLANT PATH

This application is based on Japanese Patent Application No. HEI-9-203190 filed on Jul. 29, 1997.

BACKGROUND OF THE INVENTION a) Field of the Invention

The present invention relates to an electron gun, and more particularly to an electron gun suitable for both increasing the energy of and raising a repetition frequency of an electron beam periodically emitted from the electron gun.

b) Description of the Related Art

A radio-frequency electron gun (RF gun) using a photocathode comprises a conductive chamber defining a cavity, a photocathode for emitting photoelectron into the cavity, and a wave guide for generating an RF electric field in the cavity. As light is periodically applied to the photocathode, photoelectrons are emitted into the cavity intermittently. These photoelectrons are converged and accelerated by the RF electric field generated in the cavity. The RF electric field is applied synchronously with application of light to the photocathode. For example, a repetition frequency of light application is set to about 10 Hz.

It has been desired to raise the repetition frequency of an electron beam periodically emitted from the electron gun. It has also been desired to increase the energy of the emitted electron beam.

SUMMARY OF THE INVENTION

It is an object of the present invention to provide an electron gun suitable for both increasing the energy of and raising a repetition frequency of an electron beam periodically emitted from the electron gun.

According to one aspect of the present invention, there is provided an electron gun comprising: a conductive chamber defining a cavity; a photocathode for emitting photoelectrons into the cavity when light is applied to the photocathode; a wave guide for guiding a micro wave into the cavity; an opening formed in a wall of the conductive chamber for guiding the photoelectrons emitted into the cavity out from the cavity; and a flow path for flowing coolant to forcibly cool the conductive chamber.

As a micro wave is introduced into the cavity, an RF electric field is induced in the cavity. This electric field accelerates photoelectrons emitted from the photocathode. Although a temperature of the conductive chamber is raised by the RF electric field, coolant is flowed into the flow path to suppress the temperature rise.

As above, it is possible to suppress a temperature rise of the RF gun, and both, increase the energy of and raise the repetition frequency of an electron beam periodically emitted from the electron gun.

DETAILED DESCRIPTION OF THE PREFERRED EMBODIMENTS

Prior to describing the embodiments of the invention, the structure and operation principle of a radio-frequency electron gun (RF gun) using a conventional photocathode will be described.

Figure 6:
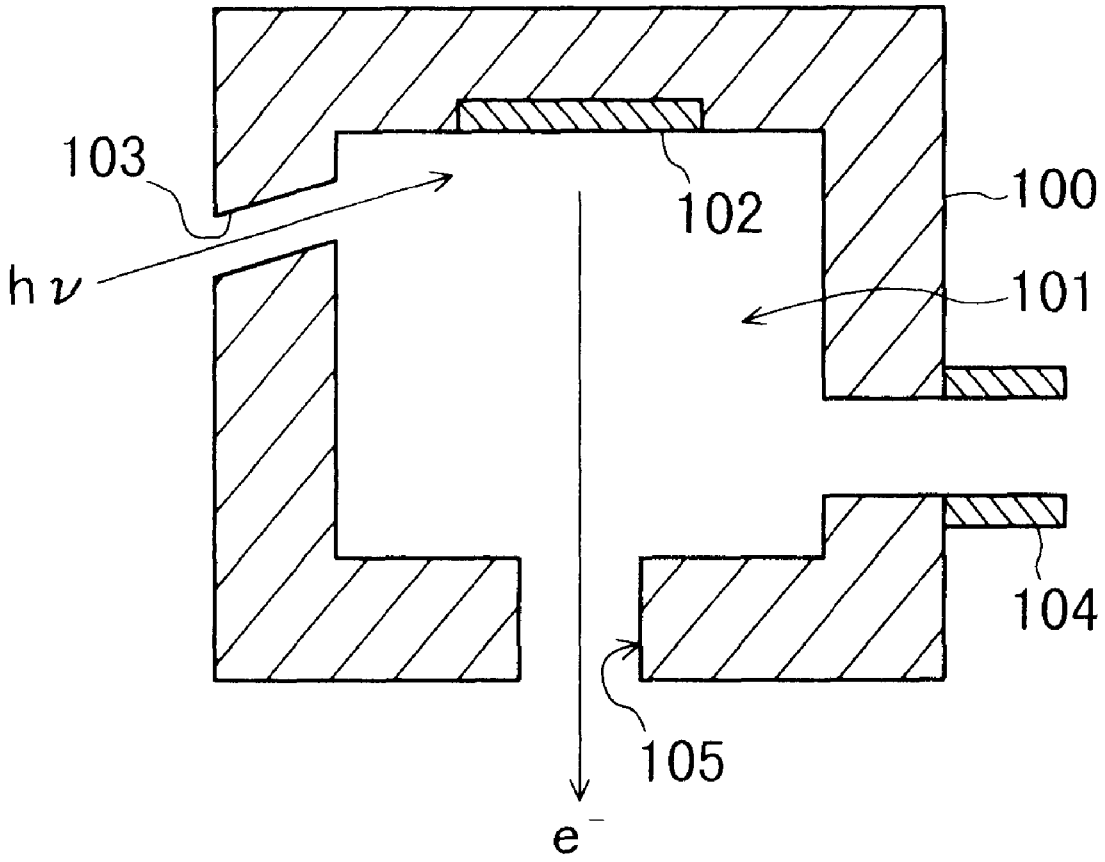
FIG.6 PRIOR ART
FIG. 6 is a cross sectional view of a conventional RF gun.

FIG. 6 is a schematic cross sectional view of a most simplified RF gun. A conductive chamber 100 defines a cavity 101. A photocathode 102 is mounted on the inner surface of the chamber 100. Light (hv) enters the inside of the cavity 101 via a window 103 formed in the side wall of the chamber 100 and illuminates the surface of the photocathode 102. Photoelectrons (e) are emitted from the photocathode 102 into the cavity 101.

A micro wave enters the inside of the cavity via a wave guide coupled to the chamber 100 so that an RF electrode is induced in the cavity 101. Photoelectrons (e) emitted from the photocathode 102 are accelerated by the RF electric field, and emitted to the outside of the chamber 100 via an opening 105 formed in the wall of the chamber 100.

Generally, light is applied to the photocathode in a pulsate manner, and a pulse electron beam is picked up synchronously with light application. A micro wave enters the inside of the cavity 101 intermittently and in synchronization with the light application.

An RF gun using a photocathode has been developed heretofore mainly as a research and development apparatus. For this reason, the repetition frequency of an electron beam emitted from the conventional RF gun has been set to about 10 Hz or lower.

The present inventor has found basing upon analytical studies that as the repetition frequency of emitting an electron beam is raised, a stable operation of the RF gun becomes difficult because of a temperature rise of the chamber. Analysis made by the inventor will be described below.

Analytical studies were made by using a one-dimensional simple model of the chamber 100 shown in FIG. 6, assuming that the chamber 100 has a tubular structure made of copper. Heat enters from the inner circumferential surface of the tubular chamber and dissipates from the outer circumferential surface thereof. An inflow heat amount from the inner circumferential surface $Q_{in}$ (kcal/hr) can be expressed by:

$$Q_{in}=2\pi\lambda L(\theta_1-\theta_2)/\ln(r_2/r_1) \quad (1)$$

where $\lambda$ (kcal/m/hr/° C.) is a heat conductivity of the chamber, L (cm) is a length of the chamber, $\theta_1$ (° C.) is a temperature of the inner circumferential surface of the chamber, $\theta_2$ (° C.) is a temperature of the outer circumferential surface, $r_1$ (cm) is a radius of the inner circumferential surface of the chamber, and $r_2$ (cm) is a radius of the outer circumferential surface.

In a steady state, an inflow heat amount from the inner circumferential surface is equal to an outflow heat amount from the outer circumferential surface. Therefore, the inflow heat amount is given by:

$$Q_{in}=h\times 2\pi r_2 L(\theta_2-\theta_3) \quad (2)$$

where h (kcal/m$^2$/hr/° C.) is a laminar film heat transfer coefficient at the outer circumferential surface of the chamber and $\theta_3$ (° C.) is an ambient temperature.

The inflow heat amount $Q_{in}$ is also given by:

$$Q_{in}=q_{in}(2\pi r_1 L/1000)\times 3600/4.18 \quad (3)$$

where $q_{in}$ (W/cm$^2$) is a power loss at the inner circumferential surface of the tubular chamber when an RF power is input.

In order to emit an electron beam with high energy, it is preferable to increase the power of the input micro wave, if possible. For example, in order to emit an electron beam of 4.3 MeV, it is necessary to supply an input RF power of 6 to 7 MW. Assuming the RF power of 6 to 7 MW, the repetition frequency of 50 Hz in emmitimg electron beam, and the light application time of 3.5 $\mu$s per one period, it can be expected empirically that a power loss at the copper surface is about 5 W/cm$^2$. If $q_{in}$=5 W/cm$^2$, $\lambda$=332 kcal/m/hr/° C., L=3.2 cm, $r_1$=4.125 cm, and $r_2$=6.67 cm, then $Q_{in}$=357.15 kcal/hr from the equation (3). Substituting this into the equation (1), it stands $\theta_1-\theta_2$=2.57° C. Namely, if an inflow heat amount from the inner circumferential surface of the tubular chamber is 5 W/cm$^2$, a temperature difference of 2.57° C. is generated between the inner and outer circumferential surfaces.

If the copper surface is cooled with natural convection, the laminar film heat transfer coefficient h is about 10 kcal/m$^2$/hr/° C. Assuming that the ambient temperature $\theta_3$ is 25° C., it stands $\theta_2$=2688° C. from the equation (2). Therefore, with the cooling by natural convection, the temperature rises to a copper melting point or higher so that the RF power of 6 to 7 MW is impossible.

The laminar film heat transfer coefficient h necessary for setting the outer circumferential temperature of the tubular chamber to 40° C. is 1775 kcal/m$^2$/hr/° C. as calculated from the equation (2) by substituting $\theta_2$=40° C. The laminar film heat transfer coefficient in this order can be achieved by using water flow in a turbulent state.

From the above studies, although it is difficult to sufficiently cool the tubular chamber with air, it can be expected that the chamber can be sufficiently cooled with water.

Next, an RF gun according to the embodiment of the invention will be described with reference to FIGS. 1A to 1C and FIGS. 2A and 2B.

Figure 1A:
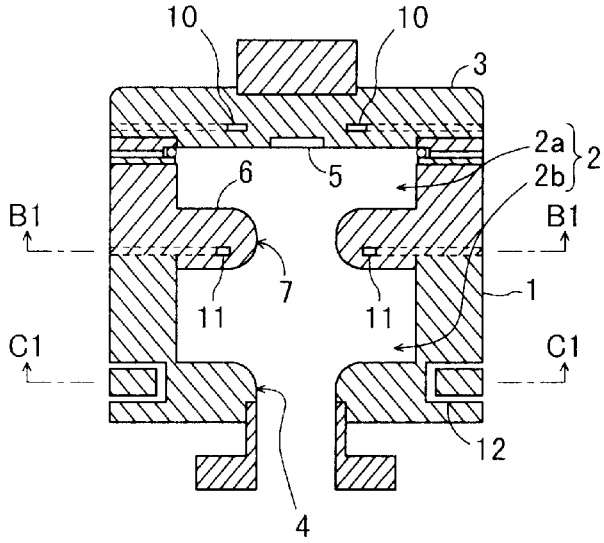
FIGS. 1A, 1B and 1C and FIGS. 2A and 2B are all cross sectional views of an RF gun according to an embodiment of the invention.

FIG. 1A is a cross sectional view of an RF gun of this embodiment. A tubular chamber 1 made of copper defines a cavity 2. One end of the tubular chamber 1 is hermetically sealed with a copper lid 3. A metal O ring is interposed between the lid 3 and tubular chamber 1 to maintain a hermetical seal. The other end of the tubular chamber 1 has a flange formed with a circular opening 4 at the center thereof.

A photocathode 5 made of magnesium is mounted on a recess of the inner wall of the lid 3, generally in the central area thereof.

A rim like protrusion 6 like a rim is formed on the inner circumference of the tubular chamber 1 at a predetermined position along the axial direction thereof, the protrusion 6 extending from the inner circumference toward the center axis of the chamber 1. The protrusion 6 defines a circular through hole 7 in the central area. The protrusion 6 divides the cavity into a first cavity 2*a* on the photocathode 5 side and a second cavity 2*b* on the opening 4 side.

Four flow paths 10 are formed in the lid 3 in 4-fold rotation symmetry with the center axis of the lid 3. Each flow path 10 extends from the outer circumference of the lid 3 to the center axis thereof, and folded in front of the center axis to return to the outer circumference.

Other flow paths 11 and 12 are formed in the side wall of the tubular chamber 1. The flow paths 11 are formed in the side wall of the tubular chamber 1 at the position corresponding to the protrusion 6 along the axial direction. The flow paths 12 are formed in the side wall of the tubular chamber 1 at the position near the opening 4.

Figure 1B:
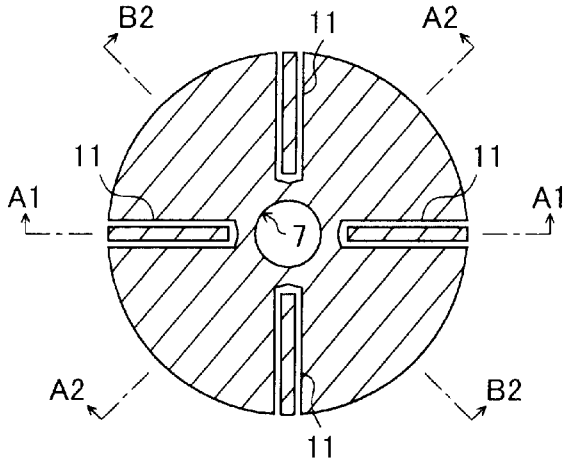

FIG. 1B is a cross sectional view taken along one-dot chain line B1—B1 of FIG. 1A at which the flow paths 11 are formed. FIG. 1A corresponds to the cross sectional view taken along one-dot chain line A1—A1 of FIG. 1B. The flow paths 11 extend in the protrusion 6 from the outer circumference surface of the tubular chamber 1 toward the center axis thereof along the radial direction. The flow paths 11 are folded at a radial position smaller in radius than that of the inner circumferential surface of the tubular chamber 1 to return to the outer circumferential surface along the radial direction.

Figure 1C:
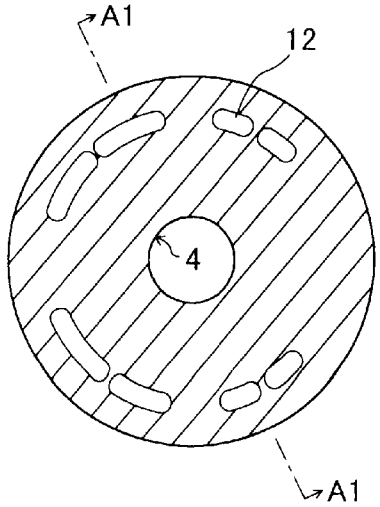

FIG. 1C is a cross sectional view taken along one-dot chain line C1—C1 of FIG. 1A at which the flow paths 12 are formed. FIG. 1A corresponds to the cross sectional view taken along one-dot chain line A1—A1 of FIG. 1C. Eight flow paths 12 are formed. Each flow path 12 is constituted of a first flow path portion extending in parallel to the center axis of the tubular chamber 1 and two second flow path portions each joining the end of the first flow path to the outer circumferential surface of the tubular chamber 1. As shown in FIG. 1C, the flow paths 12 are not disposed in rotation symmetry with the center axis, because of the mount of the wave guide to be described later with reference to FIG. 2B.

Figure 2A:
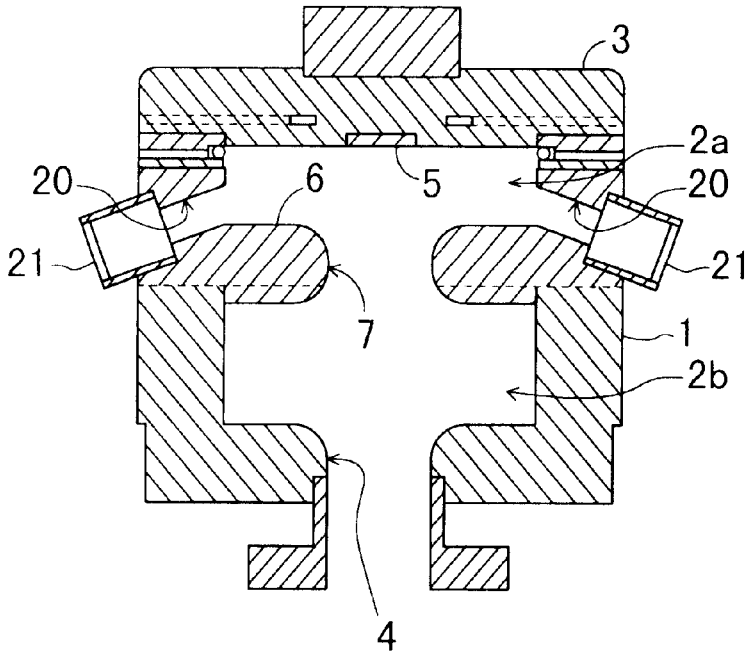

FIG. 2A is a cross sectional view taken along one-dot chain line A2—A2 of FIG. 1B. Two laser guide holes 20 are formed in the side wall of the first cavity 2*a*. Windows 21 for transmitting a laser beam are mounted in the laser guide holes 20 and maintain the interior of the cavities 2*a* and 2*b* to be air tight. A laser beam entering the first cavity 2*a* via the laser guide hole 20 becomes incident upon the photocathode 5.

Figure 2B:
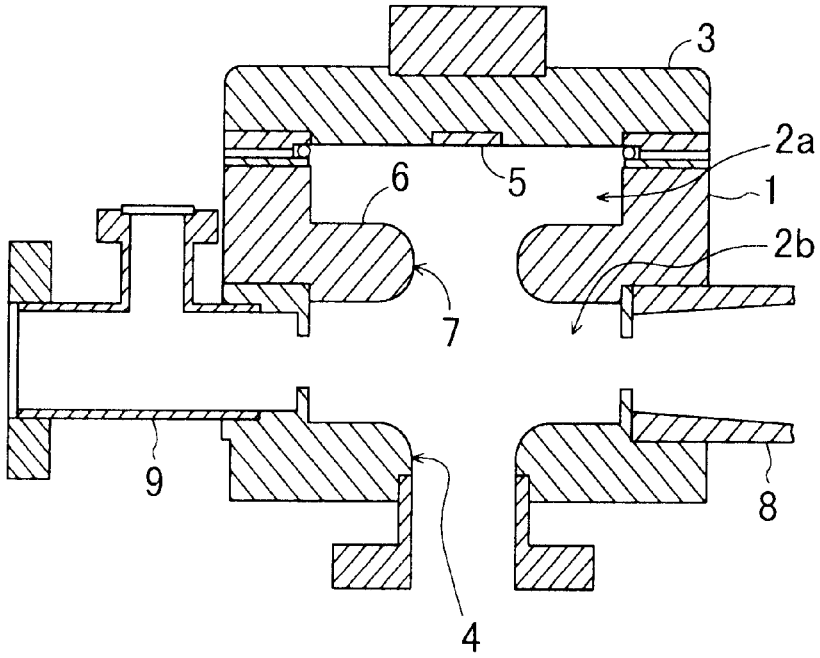

FIG. 2B is a cross sectional view taken along one-dot chain line B2—B2 of FIG. 1B. A wave guide 8 passes through the side wall of the tubular chamber 1 and communicates with the second cavity 2*b*. A vacuum duct 9 is mounted on the side wall at the position opposite to the mount position of the wave guide 8. The inside of the cavities 2*a* and 2*b* are evacuated via the vacuum duct 9.

Next, with reference to FIGS. 1A to 1C and FIGS. 2A and 2B, the operation of the RF gun will be described.

An Nd:YLF laser beam having a wavelength of 266 nm and a pulse width of 5 to 10 ps is introduced from the laser guide hole 20 shown in FIG. 2A into the first cavity 2*a*. As the laser beam is applied to the photocathode 5, photoelectrons are emitted from the photocathode 5.

Synchronously with the application of a laser beam, a micro wave having a frequency of 2.856 GHz and a power of 6 to 7 MW is introduced from the wave guide 8 shown in FIG. 2B into the second cavity 2*b*, for about 1 $\mu$s per one period. An RF electric field is therefore induced in the first and second cavities 2*a* and 2*b*.

Photoelectrons emitted from the photocathode 5 are accelerated by the RF electric field induced in the first and second cavities 2*a* and 2*b* and emitted to the outside of the tubular chamber 1 via the opening 4. In this manner, a pulse electron beam can be obtained.

Cooling water is being flowed in the flow paths 10, 11, and 12. (See FIGS. 1A, 1B and 1C.) This cooling water suppresses a temperature rise of the tubular chamber 1 and lid 3. It is therefore possible to suppress a thermal expansion of each part of the RF gun and eliminate an operation instability to be caused by the dimension change of the first and second cavities 2*a* and 2*b*. Furthermore, since a micro wave of a high power can be introduced, an electron beam of a high energy can be obtained. It is also possible to raise the repetition frequency of the emmited electron beam.

Next, results of simulation made for demonstrating the water cooling effect will be described. A model of an RF gun used for the simulation is in rotation symmetry with a center axis. Therefore, the flow paths 10, 11 and 12 are in rotation symmetry with the center axis and each have a circular ring shape.

Figure 3:
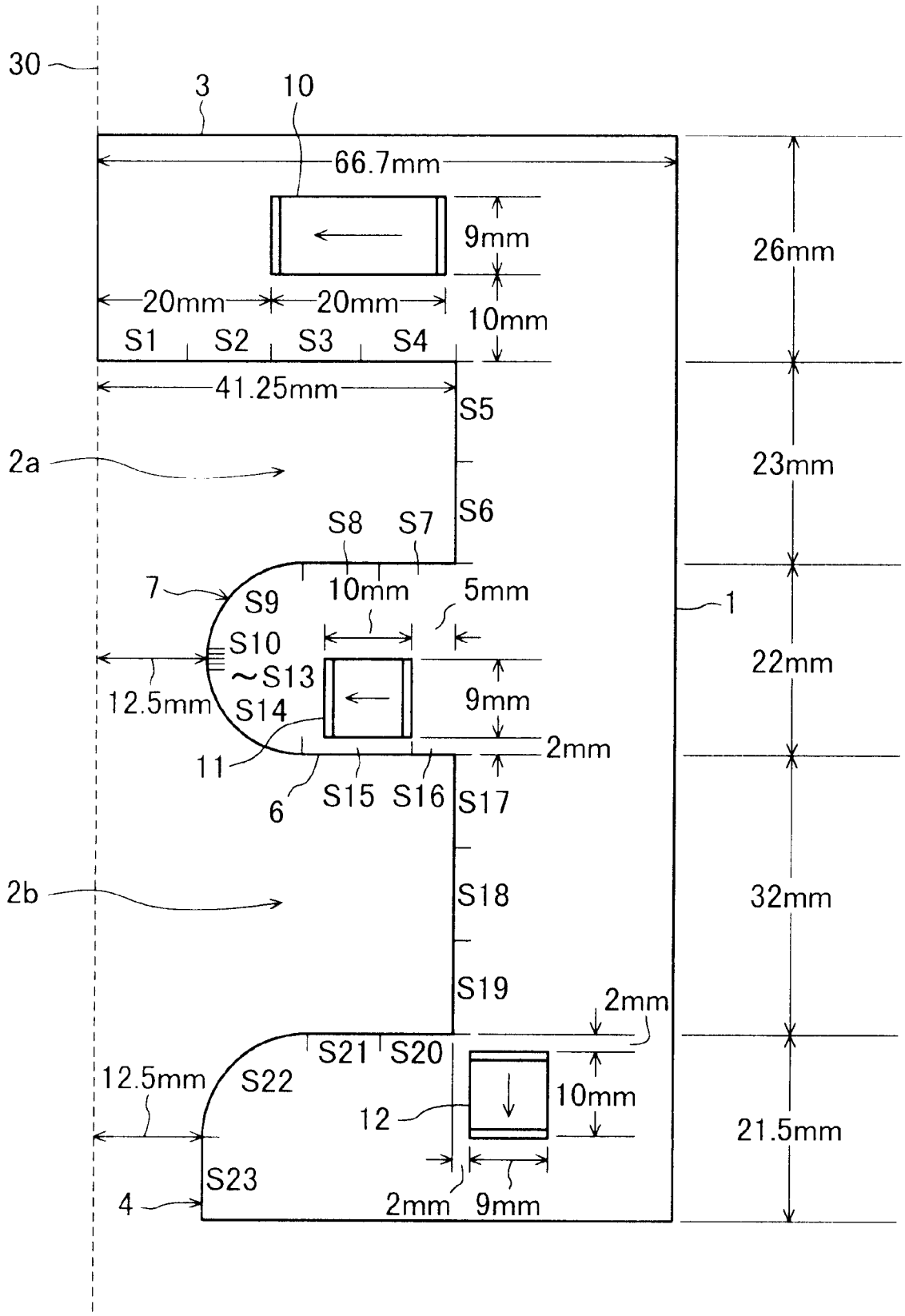
FIG. 3 is a partial cross sectional view of a simulation model of an RF gun.

FIG. 3 shows a half of the cross sectional view of the simulation model having a rotation center axis 30. In this simulation model, a thickness of the lid 3 is 26 mm, a thickness of the first cavity 2*a* is 23 mm, a thickness of the protrusion 6 is 22 mm, a thickness of the second cavity 2*b* is 32 mm, and a thickness of the flange is 21.5 mm. Of the tubular chamber 1, a radius of the outer circumferential surface is 66.7 mm, a radius of the inner circumferential surface is 41.25 mm, and the radii of the through hole 7 defined by the ends of the protrusion 6 and the opening 4 are 12.5 mm.

The flow path 10 is embedded in the recess of the lid 3. Of the flow path 10, a radius of the inner circumference is 20 mm, a radius of the outer circumference is 40 mm, a thickness along the axial direction is 9 mm, and a distance to the upper portion of the first cavity 2*a* as viewed in FIG. 3 is 10 mm. Cooling water flows from the outer circumference to the inner circumference along the radial direction.

The flow path 11 is embedded in the protrusion 6. Of the flow path 11, a radius of the inner circumference is 26.25 mm, a radius of the outer circumference is 36.25 mm, a thickness along the axial direction is 9 mm, and a distance to the upper portion of the second cavity 2*b* as viewed in FIG. 3 is 2 mm. Cooling water flows from the outer circumference to the inner circumference along the radial direction.

The flow path 12 is embedded in the side wall of the tubular chamber 1 near the flange. Of the flow path 12, a radius of the inner circumference is 43.25 mm, a radius of the outer circumference is 52.25 mm, a thickness along the axial direction is 10 mm, and a distance to the plane extending from the lower portion of the second cavity 2*b* as viewed in FIG. 3 is 2 mm. Cooling water flows from the upper portion to lower portion of the flow path 12 as viewed in FIG. 3 along a direction in parallel to the center axis 30. It was assumed that in each flow path, the water inflow and outflow planes (planes indicated by double lines in FIG. 3) were in an adiabatic state and heat inflow occurred only on the plane in parallel to the water flow.

The inner circumferential surface of the RF gun was divided into 23 regions S1 to S23, and the inflow heat amount of each region was presumably determined. The determined inflow heat amounts of the regions S1 to S23 are respectively 0.33 W/cm$^2$, 1.40 W/cm$^2$, 2.64 W/cm$^2$, 2.86 W/cm$^2$, 2.44 W/cm$^2$, 2.40 W/cm$^2$, 2.75 W/cm$^2$, 2.53 W/cm$^2$, 0.65 W/cm$^2$, 0.0008 W/cm$^2$, 0.0002 W/cm$^2$, 0.003 W/cm$^2$, 0.01 W/cm$^2$, 1.17 W/cm$^2$, 4.62 W/cm$^2$, 5.06 W/cm$^2$, 4.41 W/cm$^2$, 4.42 W/cm$^2$, 4.41 W/cm$^2$, 5.06 W/cm$^2$, 4.62 W/cm$^2$, 1.19 W/cm$^2$, and 0.01 W/cm$^2$. The distribution of these inflow heat amounts was determined in accordance with empirically obtained data, and the maximum value was set to about 5 W/cm$^2$.

The outer circumferential surface of the RF gun was assumed to be the atmosphere heat dissipation condition (laminar film heat transfer coefficient h=10 kcal/hr/m$^2$/° C.) and the inner circumferential surface (regions S1 to S23) was assumed to be the adiabatic condition. It was also assumed that a flow speed at the water inflow plane of each flow path was constant and a flow amount was conserved at the water outflow plane. An atmospheric temperature is 25° C., a temperature of cooling water at the inflow plane is 25° C., and the flow speed is 0.5 m/s. Under these conditions, flow amounts of cooling water in the flow paths 10, 11, and 12 are 67.8 l/min, 61.5 l/min and 81.0 l/min, respectively.

Figure 4:
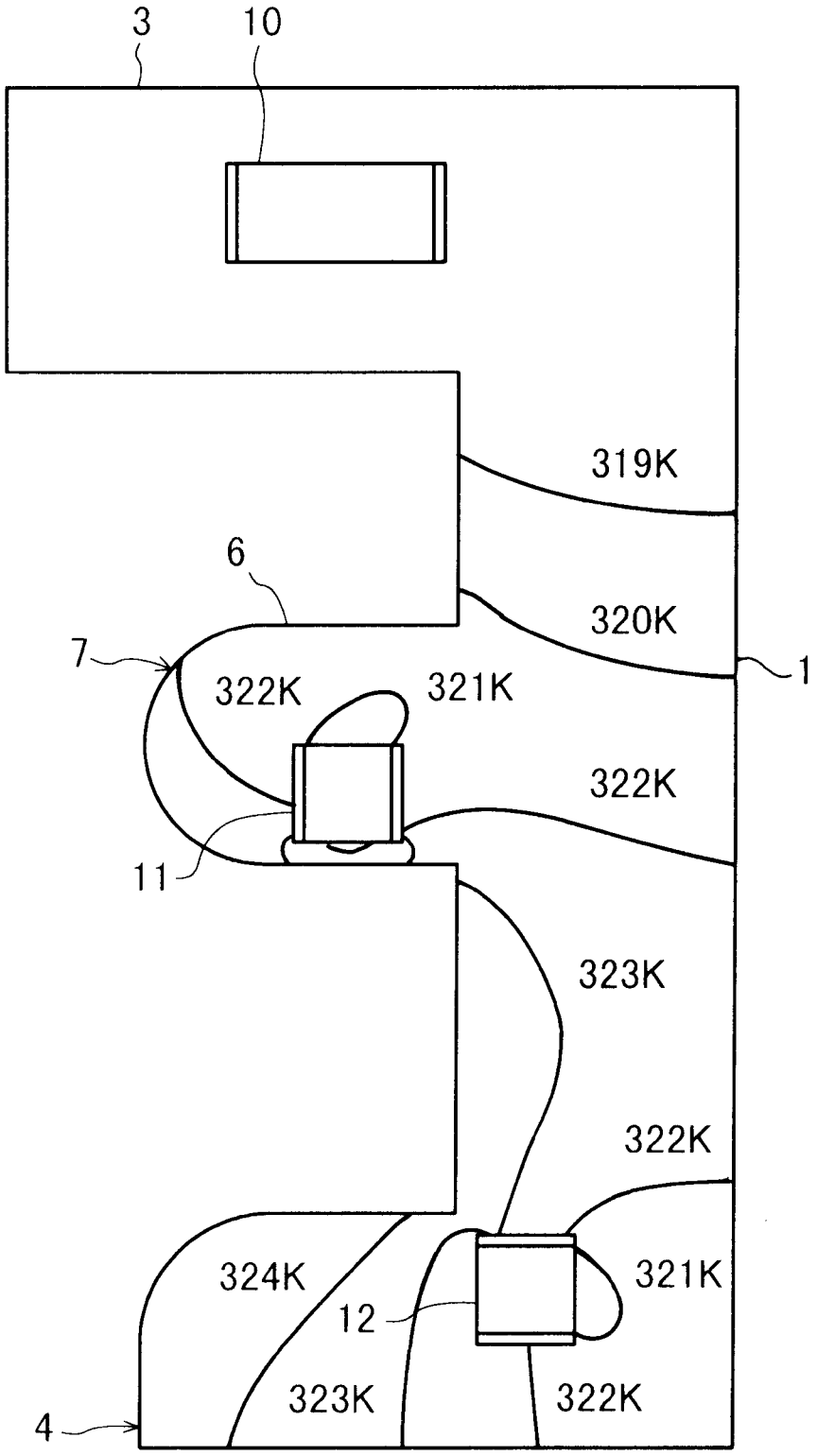
FIG. 4 is a diagram showing a temperature distribution in an RF gun.

FIG. 4 shows a temperature distribution of the RF gun. Curves shown in FIG. 4 are isothermal lines each being represented by its temperature. The region near the opening 4 was highest taking a temperature of about 325 K (52° C.). The lowest temperature was about 318 K (45° C.). A difference between the highest and lowest temperatures was about 7° C.

Simulation of an RF gun without cooling water flow paths was made under the same conditions. The distal end of the protrusion 6 took a highest temperature of about 2310 K (2037° C.), and the corners of the outer circumferential surface took a lowest temperature of about 2300 K (2027° C.). A difference between the highest and lowest temperatures was about 10° C.

As described above, by flowing cooling water in the flow paths formed in the wall of the tubular chamber of the RF gun, it is possible to suppress a temperature rise of the RF gun and reduce a temperature difference.

In the simulation model shown in FIG. 3, the flow paths of a circular ring shape are formed in the wall of the tubular chamber of the RF gun. However, each flow path of the RF gun shown in FIG. 1A is not formed continuously over the whole circumference around the center axis. The cooling performance of the RF gun shown in FIG. 1A is therefore considered to be lower than that of the simulation model. In this context, simulation was made under the stricter conditions than the simulation model shown in FIG. 3, by assuming that (Case 1) the surface of the flow path 11 on the second cavity 2*b* side was in the adiabatic state and that (Case 2) the surface of the flow path 11 on the second cavity 2*b* side and the surface of the flow path 12 on the center axis 30 side were in the adiabatic state. The other conditions were the same as the above-described simulation.

In Case 1, a highest temperature was about 331 K (58° C.), a lowest temperature was 321 K (48° C.), and a largest temperature difference was 10° C. In Case 2, a highest temperature was about 341 K (68° C.), a lowest temperature was 321 K (48° C.), and a largest temperature difference was 20° C. As compared to the simulation shown in FIG. 3, although a range of a temperature rise becomes large, it is smaller than that using only air cooling. Therefore, the effect of water cooling can be confirmed.

In applying the embodiment shown in FIGS. 1A, 1B and 1C and FIGS. 2A and 2B to an actual RF gun, it is preferable that proper flow path shapes, the number of flow paths, a flow amount of cooling water and the like are determined in accordance with the practical use conditions such as a size of an RF gun, an applied RF power, a repetition frequency and the like.

Next, another example of the structure of the flow paths 11 shown in FIGS. 1A and 1B will be described with reference to FIG. 5.

Figure 5:
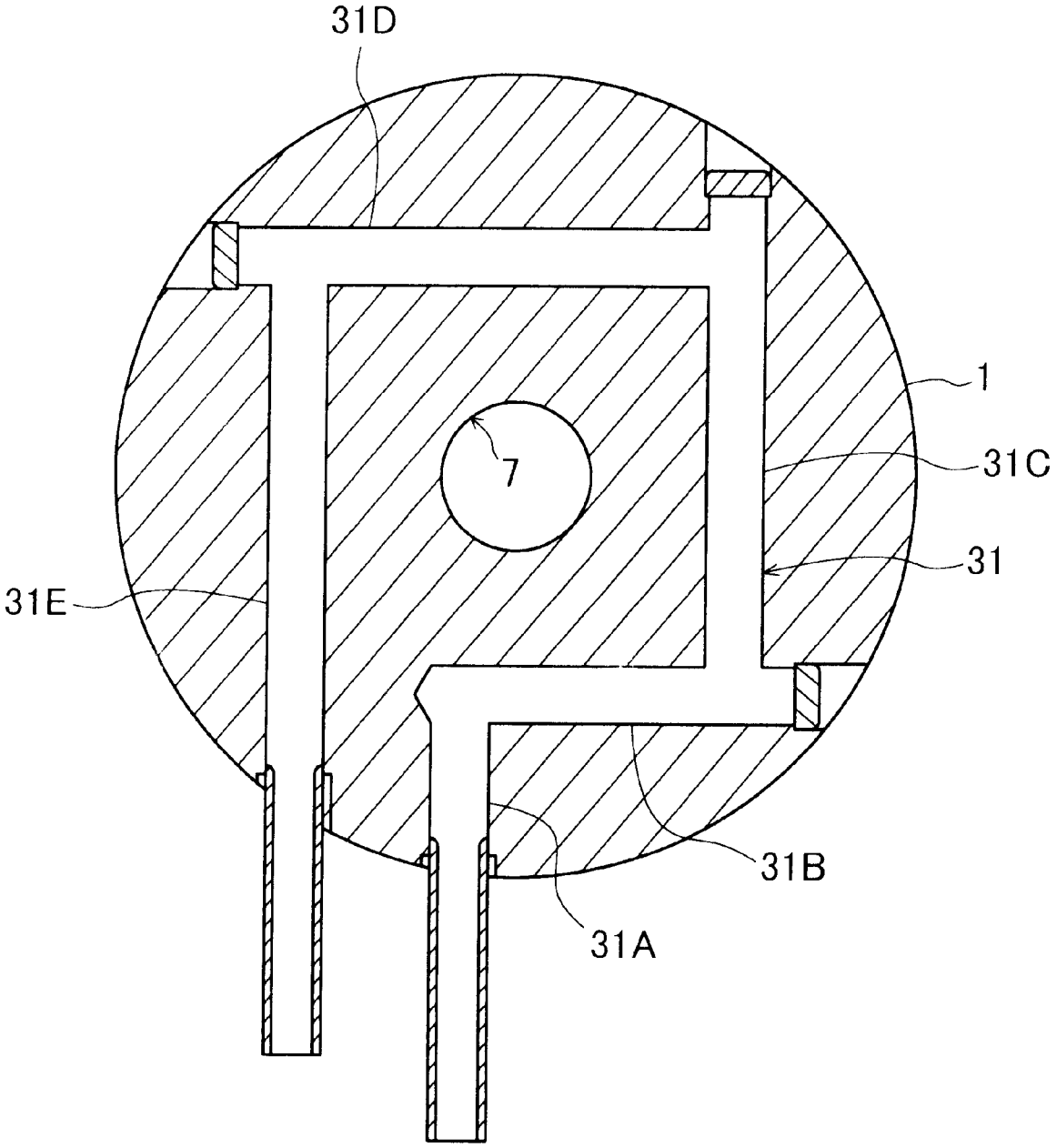
FIG. 5 is a cross sectional view showing another example of the structure of a flow path of an RF gun.

FIG. 5 is a cross sectional view corresponding to that taken along one-dot chain line B1—B1 of FIG. 1A. A flow path 31 enters the side wall of a tubular chamber 1 from the outer circumferential surface thereof, circulates around a center through hole 7, and returns to the outer circumferential surface. The flow path 31 is constituted of five straight flow path portions 31A, 31B, 31C, 31D and 31E.

Each of the flow path portions 31B to 31E is disposed along each side of a square surrounding the through hole 7. Each of the flow path portions 31B to 31E is formed by digging a straight hole along each side of the square from the outer circumferential surface of the tubular chamber 1. The holes constituting the flow path portions 31C to 31E are dug to a depth communicating with the flow path portions 31B to 31D, respectively. The hole constituting the flow path portion 31B is stopped immediately before it communicates with the flow path portion 31E, and communicates with the flow path portion 31A dug in parallel to the flow path portion 31E. Each opening of the flow path portions 31B to 31D is closed by a lid.

A partial region of each of the flow path portions 31B to 31E extends to the inside of the protrusion 6, i.e., to the position having a smaller diameter than that of the inner circumference surface of the tubular chamber 1. A distance from the center of the circular cross section to the center of each of the flow paths 31B to 31E is, for example, about 19 mm. The other sizes of the RF gun are the same as those shown in FIG. 3. With this configuration, the protrusion 6 can be cooled efficiently.

In FIG. 5, the flow path has the straight flow path portions along each side of the square. A flow path of a different configuration generally surrounding the through hole 7 once may be formed. For example, a flow path having a polygon shape having five sides as of a pentagon or more, a flow path having a circular shape or the like may be formed. Also in such a case, it is preferable to form the flow path whose partial region reaches the position having a smaller diameter than that of the inner circumferential surface of the tubular chamber 1.

The present invention has been described in connection with the preferred embodiments. The invention is not limited only to the above embodiments. It is apparent that various modifications, improvements, combinations, and the like can be made by those skilled in the art.

What is claimed is:

1. An electron gun comprising:

a conductive chamber defining a cavity;

a photocathode for emitting photoelectrons into the cavity when light is applied to said photocathode;

a wave guide coupled to the cavity for guiding a micro wave into the cavity;

an opening disposed in a wall of said conductive chamber for guiding the photoelectrons emitted into the cavity out from the cavity to form an electron beam; and a flow path through which coolant flows to forcibly cool said conductive chamber;

wherein said conductive chamber comprises a tube having an inner circumferential surface of a tubular shape and a protrusion having a through hole defined in a central area thereof, and said protrusion comprises a rim like extension from the inner circumferential surface defined by the tube toward a center axis of said conductive chamber at a position along an axial direction of said conductive chamber;

wherein said flow path enters the wall of said conductive chamber from an outer circumferential surface thereof and then returns to the outer circumferential surface, and a partial region of the flow path passes a position which is closer to the center axis of said conductive chamber than the inner circumferential surface of the tube; and wherein said flow path is folded in an inside of the protrusion at a position which is closer to the center axis of said conductive chamber than the inner circumferential surface of the tube, and then returns to the outer circumferential surface of said conductive chamber.

2. An electron gun comprising:

a conductive chamber defining a cavity;

a photocathode for emitting photoelectrons into the cavity when light is applied to said photocathode;

a wave guide coupled to the cavity for guiding a micro wave into the cavity;

an opening disposed in a wall of said conductive chamber for guiding the photoelectrons emitted into the cavity out from the cavity to form an electron beam; and a flow path through which coolant flows to forcibly cool said conductive chamber;

wherein said conductive chamber comprises a tube having an inner circumferential surface of a tubular shape and a protrusion having a through hole defined in a central area thereof, and said protrusion comprises a rim like extension from the inner circumferential surface defined by the tube toward a center axis of said conductive chamber at a position along an axial direction of said conductive chamber;

wherein said flow path enters the wall of said conductive chamber from an outer circumferential surface thereof and then returns to the outer circumferential surface, and a partial region of the flow path passes a position which is closer to the center axis of said conductive chamber than the inner circumferential surface of the tube;

wherein said flow path circulates around the through hole defined in the central area of said protrusion and then returns to the outer circumferential surface of said conductive chamber; and wherein said flow path comprises straight portions along a polygonal shape having more than four sides.

3. An electron gun according to claim 2, wherein at least one end of each straight portion of the flow path extends to the outer circumferential surface of said conductive chamber.

* * * * *